US009972290B1

(12) United States Patent
Mason

(10) Patent No.: US 9,972,290 B1
(45) Date of Patent: May 15, 2018

(54) PLECTRUM WITH SECOND STRIKING MEMBER

(71) Applicant: Christopher D. Mason, Romeoville, IL (US)

(72) Inventor: Christopher D. Mason, Romeoville, IL (US)

( * ) Notice: Subject to any disclaimer, the term of this patent is extended or adjusted under 35 U.S.C. 154(b) by 0 days. days.

(21) Appl. No.: 15/658,332

(22) Filed: Jul. 24, 2017

(51) Int. Cl.
*G10D 3/16* (2006.01)

(52) U.S. Cl.
CPC ..... *G10D 3/163* (2013.01)

(58) Field of Classification Search
CPC ..... G10D 3/163
See application file for complete search history.

(56) References Cited

U.S. PATENT DOCUMENTS

| | | | | |
|---|---|---|---|---|
| 3,304,826 | A | 2/1967 | Caron | |
| 3,312,137 | A | 4/1967 | Oddo | |
| 4,398,444 | A | 8/1983 | Walker | |
| 4,651,614 | A * | 3/1987 | Cavallo | G10D 3/163 84/322 |
| 5,253,562 | A | 10/1993 | Kline | |
| D358,833 | S | 5/1995 | Ridley | |
| 5,594,189 | A | 1/1997 | Latteri | |
| 6,342,661 | B1 * | 1/2002 | Flamm | G10D 3/163 84/320 |
| D577,379 | S | 9/2008 | Morris | |
| 7,825,315 | B1 | 11/2010 | King | |
| D632,727 | S * | 2/2011 | Goad | D17/20 |
| D632,728 | S * | 2/2011 | Goad | D17/20 |
| D632,729 | S * | 2/2011 | Goad | D17/20 |
| 2009/0056521 | A1 | 3/2009 | Goad | |
| 2012/0260788 | A1 | 10/2012 | Leneman | |
| 2014/0033894 | A1 | 2/2014 | Taylor | |
| 2014/0090540 | A1 | 4/2014 | Panagiotes | |

* cited by examiner

*Primary Examiner* — Robert W Horn
(74) *Attorney, Agent, or Firm* — Chicago IP Law; Steven M. Evans

(57) ABSTRACT

A one-piece, hand-held device that enables users to pick, pluck, strum, or strike strings of a musical instrument simultaneously. The device comprises a first planar plectrum having a grasping surface and a striking surface in the same plane and a second planar plectrum secured to the first planar plectrum by a bracket located at the midsection of the first planar plectrum the top of the second planar plectrum, wherein the first planar plectrum is substantially parallel to the second planar plectrum.

20 Claims, 11 Drawing Sheets

FIG. 8
(Replacement Sheet)
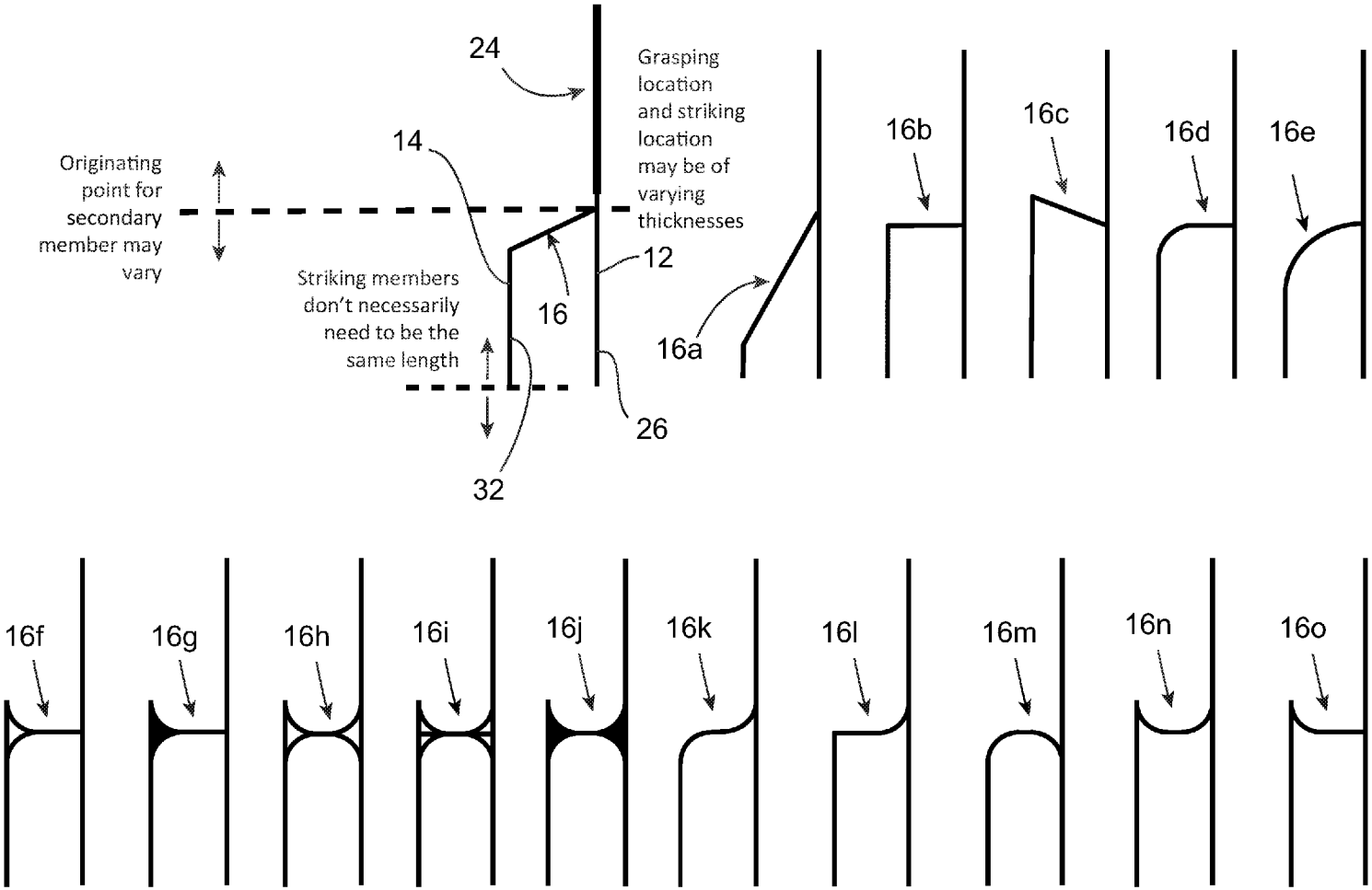

PLECTRUM WITH SECOND STRIKING MEMBER

BACKGROUND OF THE INVENTION

Field of the Invention

The present invention relates generally to a plectrum for picking, plucking or strumming (striking) the strings of a musical instrument and, more particularly, to an adaptation of a traditional single-planar plectrum design that enables a user to strike multiple strings of a musical instrument simultaneously.

Description of Related Art

Various devices currently exist for striking multiple strings of a musical instrument. These known-in-the-art (known) devices for striking multiple strings of a musical instrument either rely on multiple striking members adjoined in a manner that result in an unconventional and undesirable grasping condition, or utilize striking members that are not in direct alignment with the grasping member of the striking device. Furthermore, these devices deviate from the preferred linear archetype for guitar picks or plectrums used to strike the strings of musical instruments, and thus introduce anomalies and impediments to the devices' usage and adoption by musicians.

For example, existing known multi-string striking devices require musicians to modify their grasp, technique and playing style to compensate for atypical characteristics of the devices. This disruption of playing technique by musicians using existing known multi-string striking devices occurs because these devices either a.) Adversely alter the thickness of the grasping location and surface relative to the striking locations or surfaces or b.) Prevent the grasping location or surface from being linear or in the same plane as the striking location or surface, both of which result in unnatural grasping and striking relationships and conditions to a musician using a conventional multi-string striking device.

Accordingly, there is an unmet need for a multi-string striking device with a design and configuration that does not create atypical grasping and striking conditions and relationships. There also is a need for a multi-string striking device with a grasping surface and primary striking surface that are in alignment or in the same plane.

ASPECTS AND SUMMARY OF THE PRESENT INVENTION

One aspect of the present invention is to provide a multi-string striking device that strikes multiple strings of a musical instrument, such as a guitar, simultaneously.

Another aspect of the present invention is to provide a multi-string striking device for a musical instrument that feels natural to a musician by maintaining the grasping surface and primary striking surface of the device within the same plane.

A further aspect of the present invention is to provide a multi-string striking device with a grasping surface that feels similar in thickness and shape as a conventional striking device, such as a guitar pick or a single-surface plectrum.

An additional aspect of the present invention is to provide a multi-string striking device that is constructed from a unitary material or substance.

In order to provide these aspects and others, the present invention provides a one-piece, hand-held device that enables users to pick, pluck or strum (strike) two strings of a musical instrument simultaneously. The device comprises a first planar plectrum having a grasping location and a primary striking location in the same plane and a second planar plectrum secured to the first planar plectrum by a bracket, wherein the first planar plectrum is parallel, substantially parallel, or within ten degrees of parallel to the second planar plectrum. The result is a user experience that is substantially similar to that of using a traditional plectrum having a single striking surface, with the added functionality and benefit of an ancillary and integrated secondary striking surface for the purpose of striking two strings of a musical instrument, such as a guitar, simultaneously.

When utilized, the device can be grasped and the primary striking location used to strike a single string of a musical instrument in a manner substantially similar to using a traditional, single piece, linear guitar pick, while the ancillary secondary striking surface simultaneously strikes a string located directly above the first single string. By rotating the device horizontally 180°, the ancillary secondary striking surface can instead be used to strike a string located directly below the first single string. These two applications create distinctly different musical results, with the secondary accompanying note being played either above or below the primary note, while introducing no grasping or alignment anomalies that may impede a user's technique, experience or performance.

All known prior art devices produced for the purpose of striking multiple strings of a musical instrument simultaneously require a user to make special accommodations to achieve the benefit of the device. For example, using a device with a spacer material separating two striking locations or surfaces, such as US patent publication number 2014/0033894 by inventor Taylor, requires the user to grasp and manipulate a device that is substantially thicker than a traditional pick or plectrum. In other designs, such as U.S. Pat. No. 6,342,661 by inventor Flamm, neither of the two striking surfaces are in direct alignment with the location of the grasping surface, or "where it's supposed to be" in the mind of the user, based on their conditioning and muscle memory from, and compared with, using a traditional pick or plectrum. In both of these examples, these deviations, mentally, require that a portion of the user's concentration be directed toward using and accommodating for the atypical characteristics of the device itself, and, physically, require the development of a new or modified grasping/striking technique, potentially impeding speed, accuracy, creativity and the musical performance. This device introduces no grasping or alignment anomalies, nor requires the development of a new technique. It can literally be substituted for a traditional pick and a user will instantly reap the benefit of the second string accompaniment.

For example, a person, playing a musical instrument with a traditional pick can hold a chord position on the neck of the instrument and pick a repeating phrase or pattern. The traditional pick can then be substituted with this device and, without special accommodation or altering the grasping or picking technique; the user will reap the benefit of the second accompanying note. In this way, the device functions as a utilitarian substitute with a significant added benefit that can more easily and readily be adopted by musicians and the marketplace.

Furthermore, the easy adoption of the device can make it an excellent tool for teaching children or beginner students music theory. By incorporating the device into a music lesson, a student holding a certain chord position can simultaneously play and learn about intervals above or below the primary note being played, thus illustrating, in real time, certain aspects and principles of music theory, by physically performing the exact same movements as they would with a traditional pick. This can serve to make the lesson and learning experience more effective, interesting and enjoyable by producing "twice as much music" while doing the same thing as one would with a single, traditional pick.

Moreover, in the hands of a proficient soloist, the device of the present invention can be used to strike a series of paired single notes simultaneously, simulating two instruments playing complementary, harmonizing parts, while maintaining the natural dynamics and nuances of an individual pick or plectrum on each string and without the need for an accompanying musician or electronic devices known as "loopers" or "harmonizers".

The foregoing has outlined, rather broadly, the preferred features of the present invention so that those skilled in the art may better understand the detailed description of the invention that follows. Additional features of the invention will be described hereinafter that form the subject of the claims of the invention. Those skilled in the art should appreciate that they can readily use the disclosed invention and specific embodiments as a basis for designing or modifying other structures for carrying out the same purposes of the present invention, and that such other structures do not depart from the spirit and scope of the invention in its broadest form.

BRIEF DESCRIPTION OF THE DRAWINGS

FIG. 8 illustrates numerous side views of different embodiments of the present invention;

DETAILED DESCRIPTION OF THE PREFERRED EMBODIMENT

Figure 1:
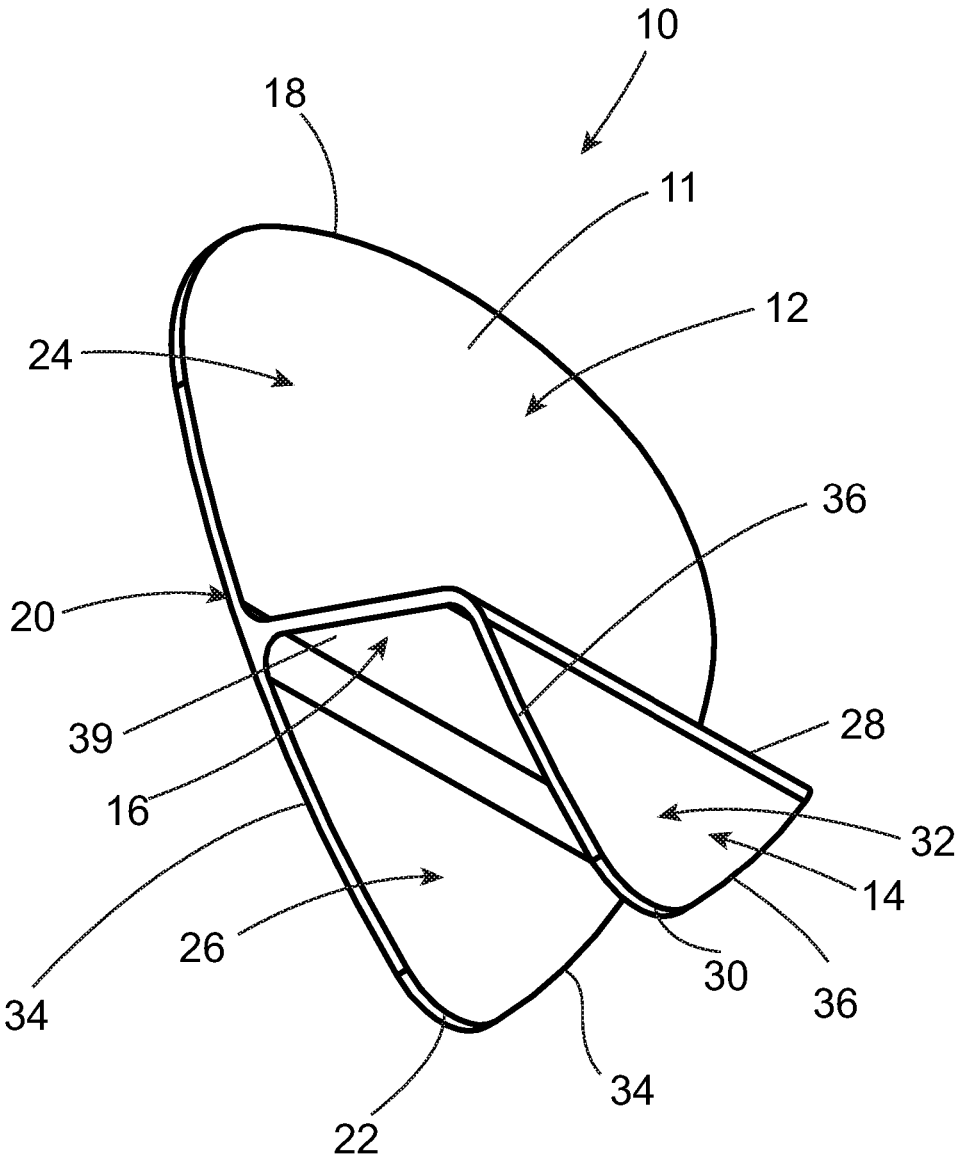
FIG. 1 is a perspective view of a multi-string striking device configured in accordance with the present invention.

Referring now to the drawings, FIG. 1 is a perspective view of a multi-string striking device 10 configured in accordance with the present invention. FIG. 1 illustrates a first side 11 of the device 10. The device or plectrum 10 includes a first planar member or first planar plectrum 12 and a second planar member or second planar plectrum 14. A bracket 16 connects the second planar member 14 to the first planar member 12. The first planar member 12 and the second planar member 14 preferably are positioned to be in parallel.

The first planar member 12 includes a top 18, a midsection 20, and a bottom 22. A grasping location or surface 24 is located between the top 18 and the midsection 20. A striking location or surface 26 is located between the midsection 20 and the bottom 22. The second planar member 14 has a top 28 and a bottom 30. A striking location 32 is located between the top 28 and the bottom 30. The bracket 16 is connected to the midsection 20 of the first planar member 12 and the top 28 of the second planar member.

The device or plectrum with ancillary striking member 10 preferably is formed from a single material or substance, such a plastic or vinyl. Alternatively, other materials with sufficient or equivalent rigidity and flexibility can be used. The grasping surface or grasping location 24 and the striking surface or striking location 26 are linear and within the same plane. Similarly, the thickness of the grasping location 24 and the thickness of the striking location preferably are equal. This feature enables the device 10 to have the same feel to a musician as a traditional single guitar pick or plectrum. Furthermore, the second planar member 14 is linear and planar, and parallel to the first planar member 12. The second planar member 14 preferably has the same thickness as the first planar member 12. Thus, the feel of the first and second striking surfaces 26 and 32 have the same picking and striking feel to a user.

In accordance with the present invention, the second planar plectrum or second planar member 14 is attached to the first planar plectrum or first planar member 12 by the bracket 16 at the midsection 20 of the of the first planar member 12. This design enables a user to hold or grasp the device 10 at the grasping location 24 which has the same thickness and feel as a traditional, single plectrum with a consistent thickness between the grasping area and the striking area. Similar to a traditional single plectrum or guitar pick, the grasping location 24 and the striking location 26 of the first planar plectrum 12 are linear and within the same geometric plane, thus planar. In its preferred embodiment, an angle formed between the bracket 16 and the striking location 26 of the first plectrum 12 is less than 90 degrees.

In accordance with another aspect of the present invention, the perimeter 34 size and shape of the striking location 26 of the first planar member can be equivalent to the perimeter 36 size and shape of the striking location 32 of the second planar member 14. In other words, the striking surfaces 26 and 32 of the first and second planar members 12, 14, respectively, are equivalent, thus each providing a similar feel to a musician as traditional single guitar pick or plectrum. In the illustrated embodiment, however, the striking location 32 of the second planar member 14 is slightly smaller than the striking location 26 of the first planar member.

Additionally, as illustrated in FIG. 1, the vertical distance from the bottom 22 of the first planar member to the top 18 of the first planar member preferably is equal to the vertical distance from the bottom 30 of the second planar member 14 to the top 18 of the first planar member 12.

Figure 2:
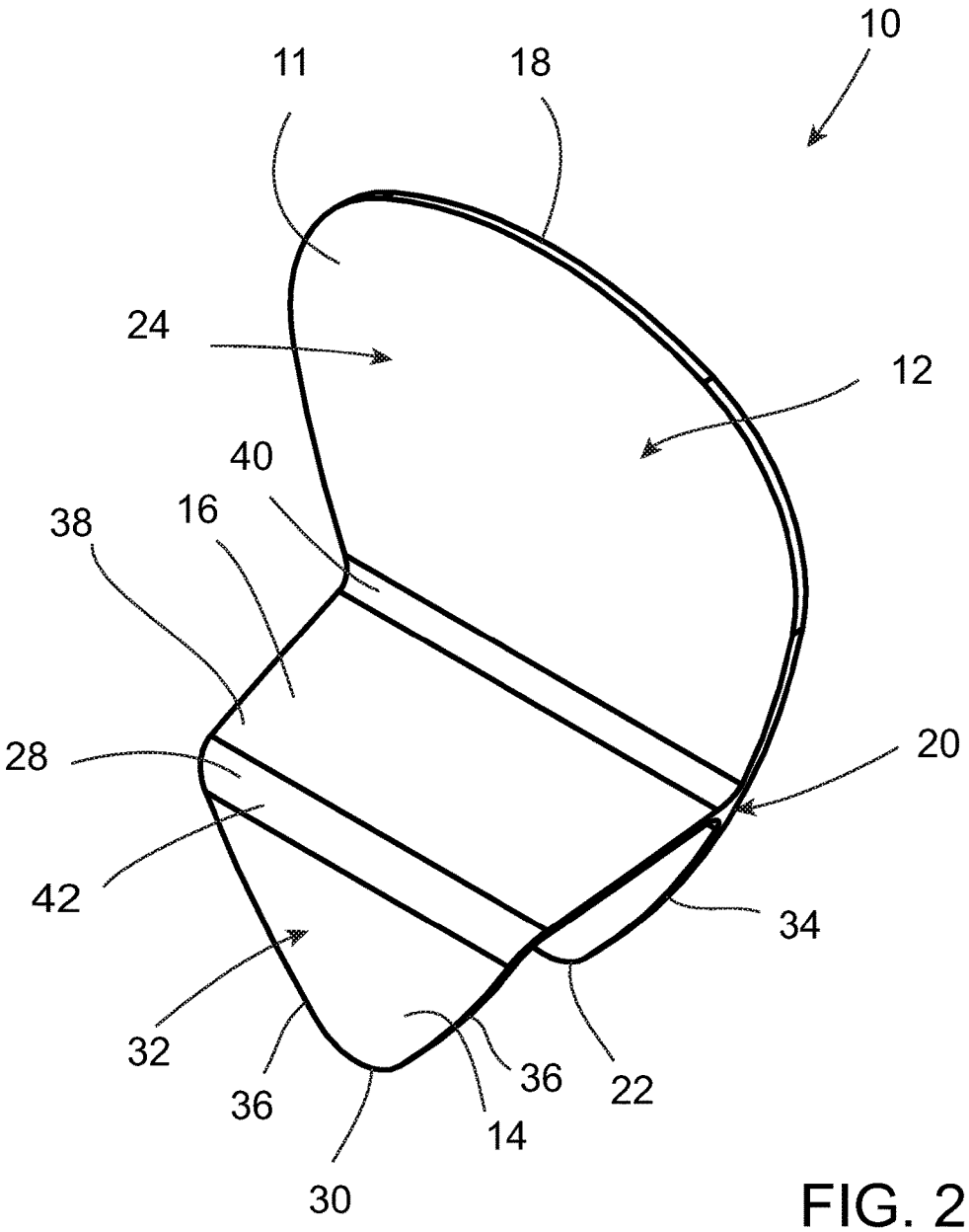
FIG. 2 is a perspective view of the device shown in FIG. 1 from a different angle.

FIG. 2 is a perspective view of the front or first side 11 of the device 10 shown in FIG. 1 from a different angle, wherein the top 38 of the bracket 16 is more clearly illustrated. FIG. 1 provides a perspective view of the bottom 39 of the bracket 16. Similar to FIG. 1, FIG. 2 illustrates the first planar member 12 and the second planar member 14, connected together by the bracket 16. The bracket 16 preferably is planar and is connected to the midsection 20 of the first planar member 12 and the top 28 of the second planar member 14. The width of the striking location 32 on the second planar member 14 decreases from the top 28 to the bottom 30 of the second planar member 14. Similarly, the width of the first planar member 12 decreases from the midsection 20 to the bottom 22 of the first planar member 12.

Figure 3:
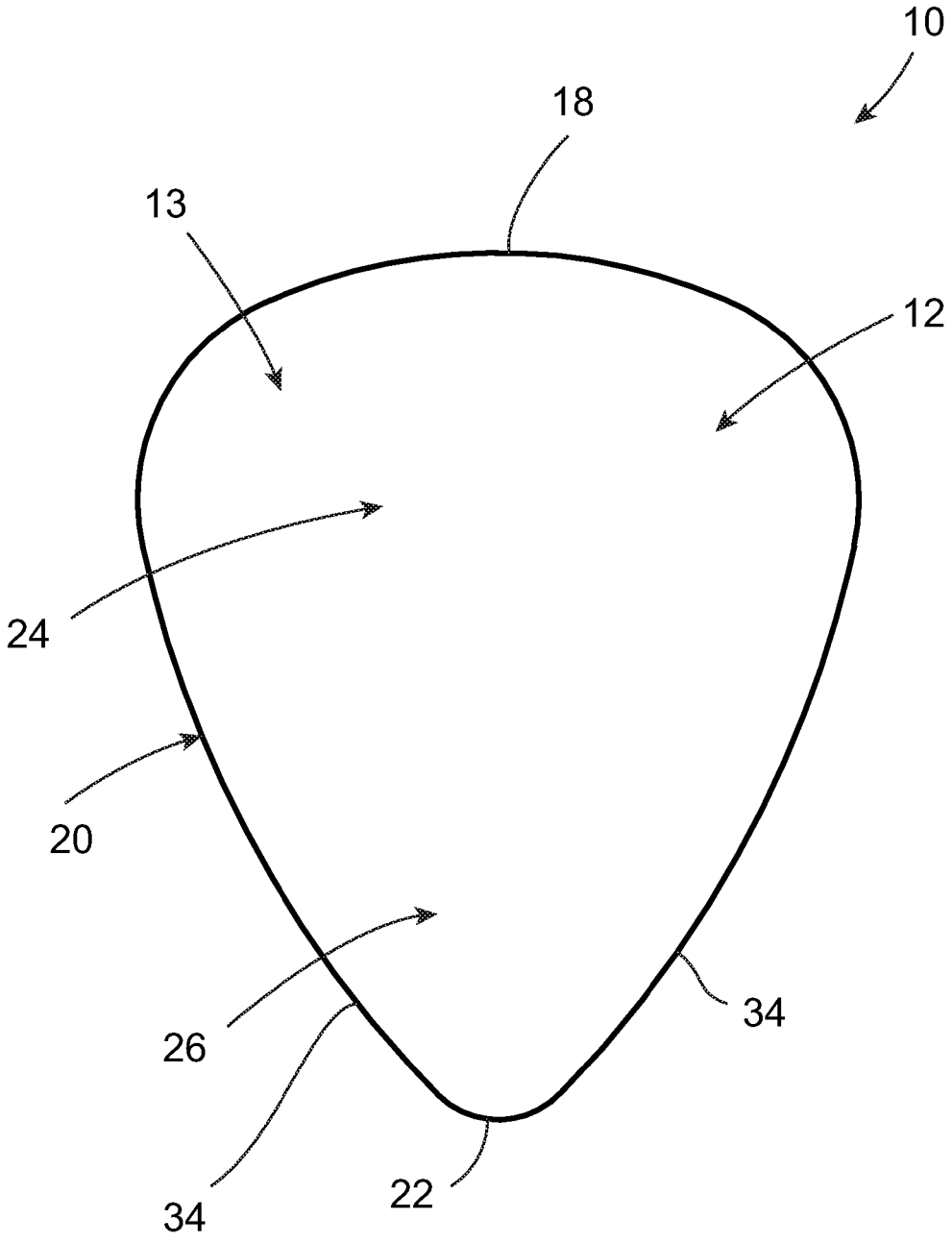
FIG. 3 is a rear view of the device shown in FIGS. 1 and 2.

FIG. 3 illustrates the back or second side 13 of the first planar member or first planar plectrum 12 shown in FIGS. 1 and 2. Illustrated are the grasping location 24 and the striking location 26. Also illustrated are the top, midsection 20, and bottom 22 of the first planar member 12. The perimeter 34 between the midsection 20 and the bottom 22 of the first planar member 12 further are illustrated.

Figure 4:
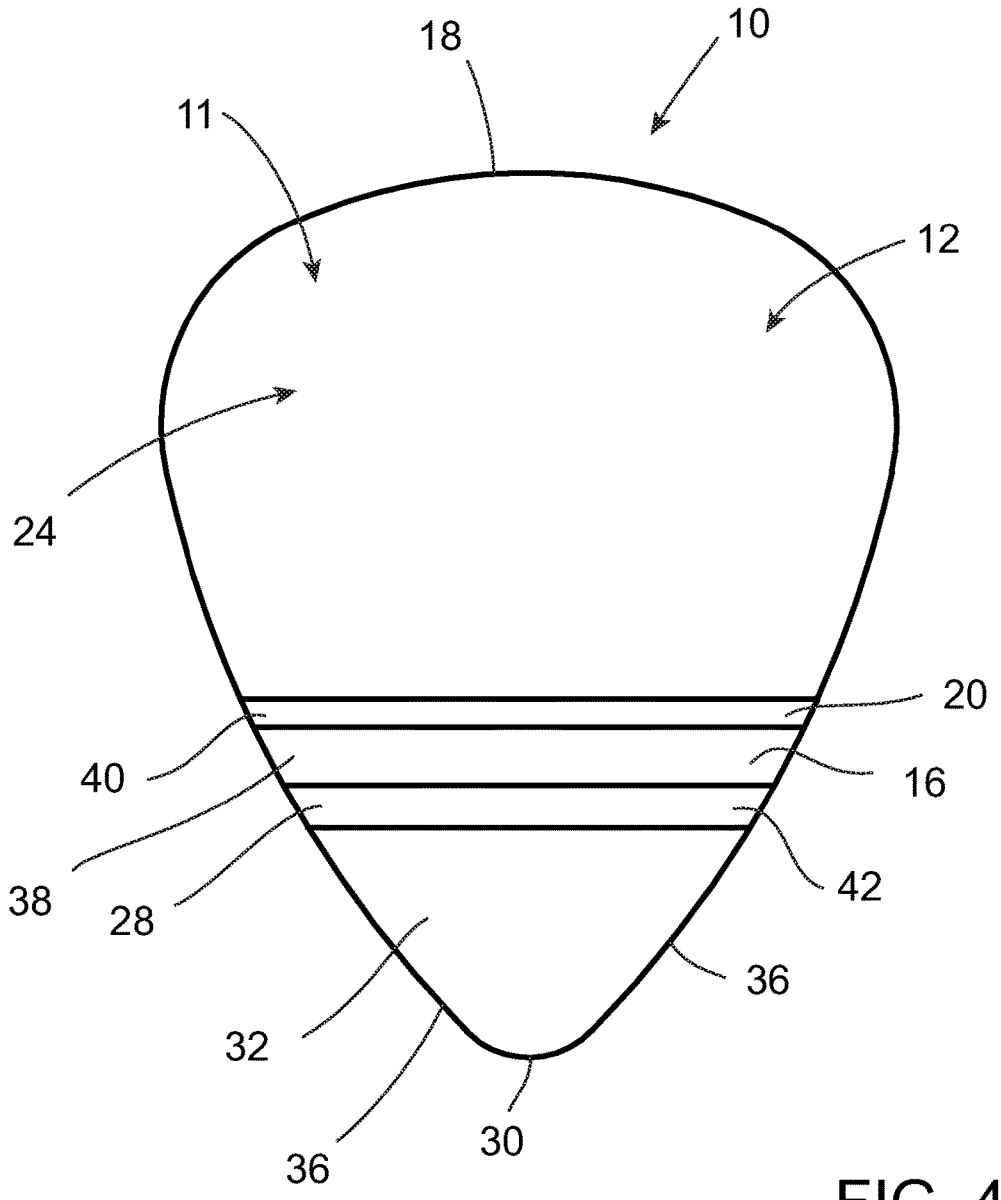
FIG. 4 is a front view of the device shown in FIGS. 1-3.

FIG. 4 illustrates a front view of the first side 11 of the device 10 shown in FIGS. 1-3. Illustrated are the striking grasping surface 24 of the first planar member 12 and the striking surface 32 of the second planar member 14. The top 18 and the midsection 20 of the first planar member 12 are illustrated. The top 28 and bottom 30 of the second planar member 14 are illustrated, including the perimeter 36 of the striking surface 32.

In addition to the top 38 of the bracket 38 being shown, the curved interface and junction 40 between the bracket and the midsection 20 of the first planar member 12 is shown. This curved interface 40 provides a strong junction between the bracket 16 and the first planar member 12. This strong junction or connection 40 between the bracket 16 and the first planar member 12 is important to maintain the parallel relationship between the first planar member 12 and the second planar member 14. Also shown is the curved transition and junction 42 between the bracket 16 and the top 28 of the second planar member. Similarly, the curved junction 42 between bracket 16 and the second planar member 14 is important to maintain the parallel relationship between the second planar member 14 and the first planar member 12.

Figure 5:
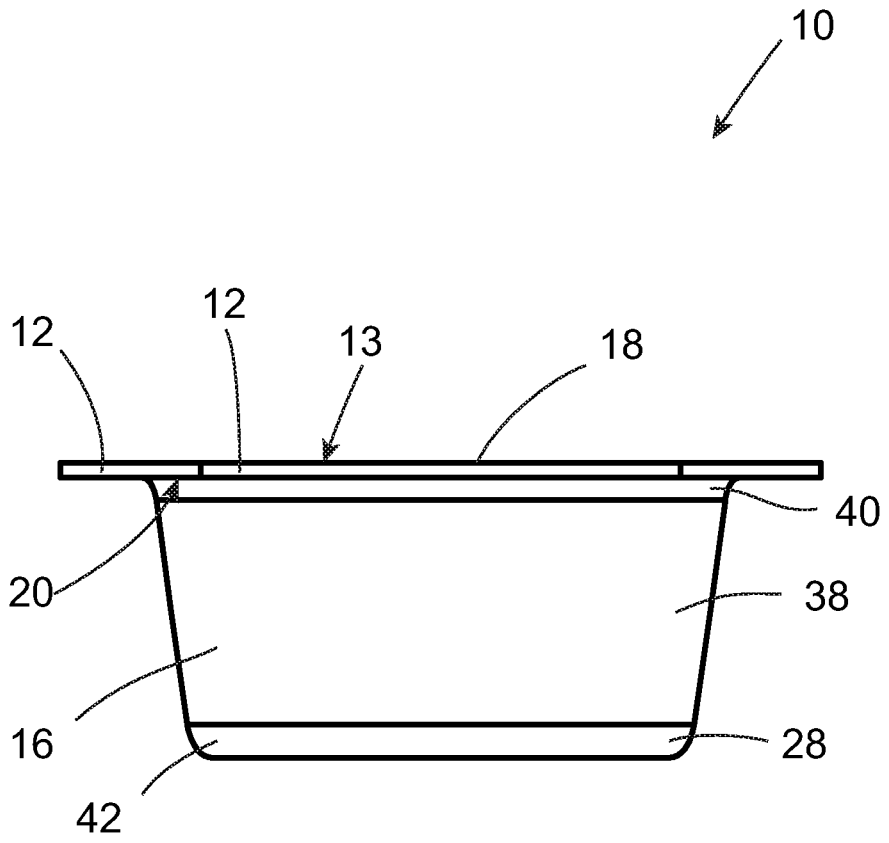
FIG. 5 is a top view of the device shown in FIGS. 1-4.

FIG. 5 is a top view of the device 10 shown in FIGS. 1-4. Illustrated are top 18 of the first planar member 12 and the top 38 of the bracket 16. Further shown are the curved junction 40 between the midsection 20 of the first planar member 12 and the bracket 16. Also illustrated is the curved junction 42 between the bracket 16 and the top 28 of the second planar member 14.

Figure 6:
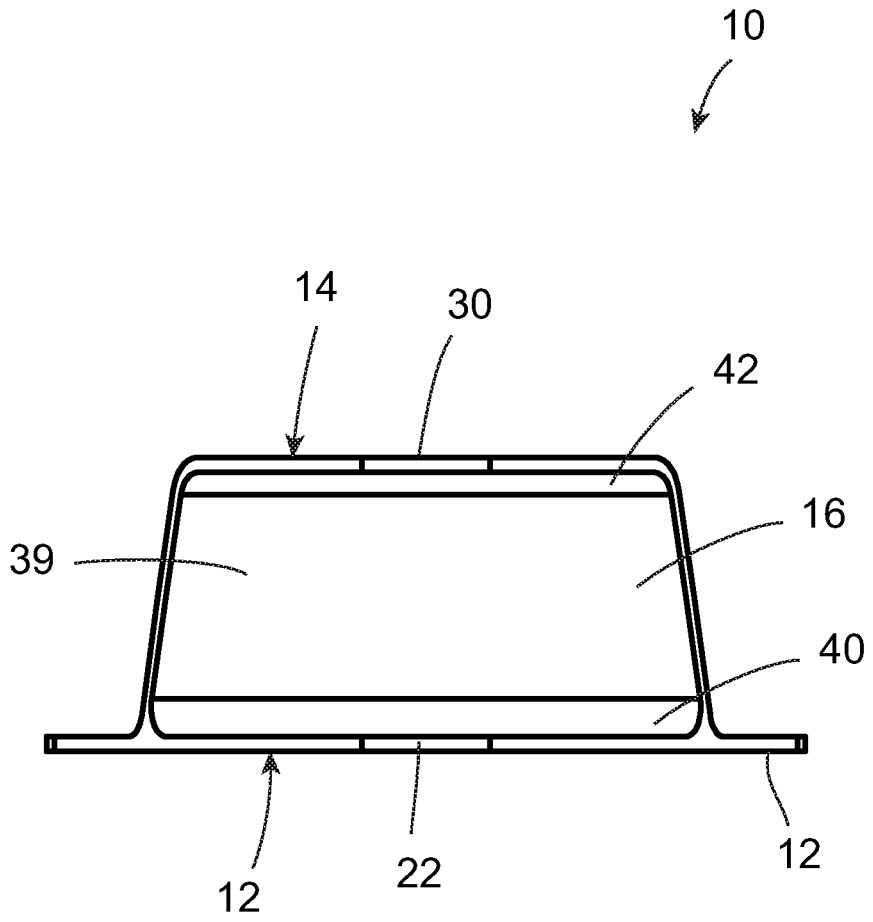
FIG. 6 is a bottom view of device shown in FIGS. 1-5.

FIG. 6 is a bottom view of the device 10 shown in FIGS. 1-6. Illustrated are the bottom 22 of the first planar member 12 and the bottom 30 of the second planar member 14. The bottom 39 of the bracket 16 also is illustrated. The curved junction 40 between the first planar member 12 and the bracket 16 is shown. The curved junction 42 between the second planar member 14 and the bracket 16 also is shown.

Figure 7:
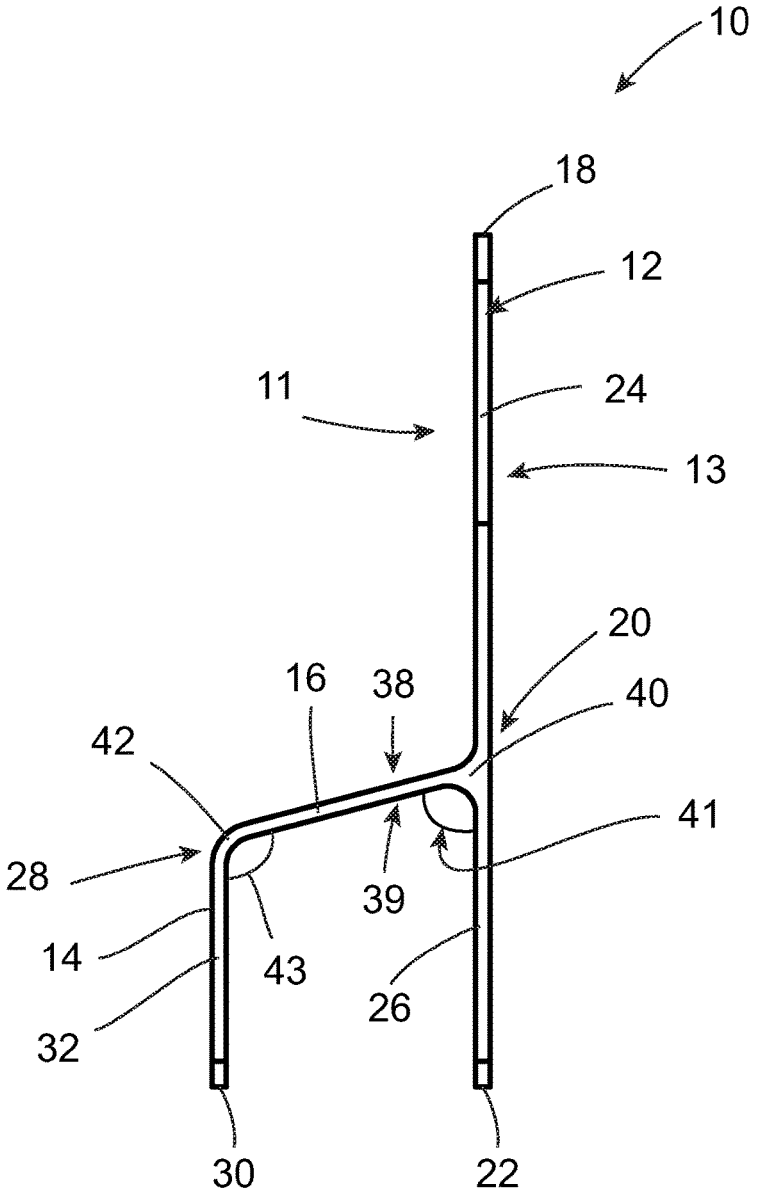
FIG. 7 is a side view of the present invention shown in FIGS. 1-6.

FIG. 7 is a side view of the device 10 shown in FIGS. 1-6. Illustrated are the first planar member 12, the second planar member 14, and the bracket 16. The grasping location or grasping surface 24 and the striking location or striking surface 26 of the first planar member 12 are shown, as well as the first side 11 and the second side 13 of the first planar member 12. The angle 41 formed between the striking surface 26 and below the bracket 16 preferably is less than 90 degrees, or an acute angle. The angle formed between the striking surface or striking location 32 and under the bracket 16 preferably is greater than 90 degrees, or an obtuse angle. The top surface 38 and the bottom surface 39 of the bracket 16 also are shown.

The second planar member 14 and the striking surface or striking location 32 are illustrated. The curved connections 40 and the 42 between the bracket 16 and the first planar member 12 and the second planar member 14, respectively, are further illustrated. While not necessary, the distance from the bottom 22 of the first planar member 12 and the bottom 30 of the second planar member 14 preferably are equal distance vertically from the top 18 of the first planar member 12.

FIG. 8 illustrates side views of multiple variations for the configuration of the bracket 16 (see brackets **16*a*-16*n*) relative to the first and second planar members 12 and 14. For example, the bracket 16 preferably forms an acute angle with the striking location 26 of the first planar member 12 and below the bracket 16. Additionally, the junctions between the bracket 16 and the first and second planar members 12 and 14** can be various configurations as illustrated, but are preferably curved.

The thickness of the grasping location 24 preferably is the same thickness as the striking location 26, but can be thicker or thinner than the striking location 26. Additionally, the bracket 16 preferably connects to the first planar member 12 at the midsection 20, but can connect at other locations or positions on the first planar member 12. Moreover, the distance of the bottoms 22 and 30 of the striking surfaces or locations 26 and 32 vertically to the top 18 of the first planar member 12 preferably are equal, but not necessarily.

Figure 9:
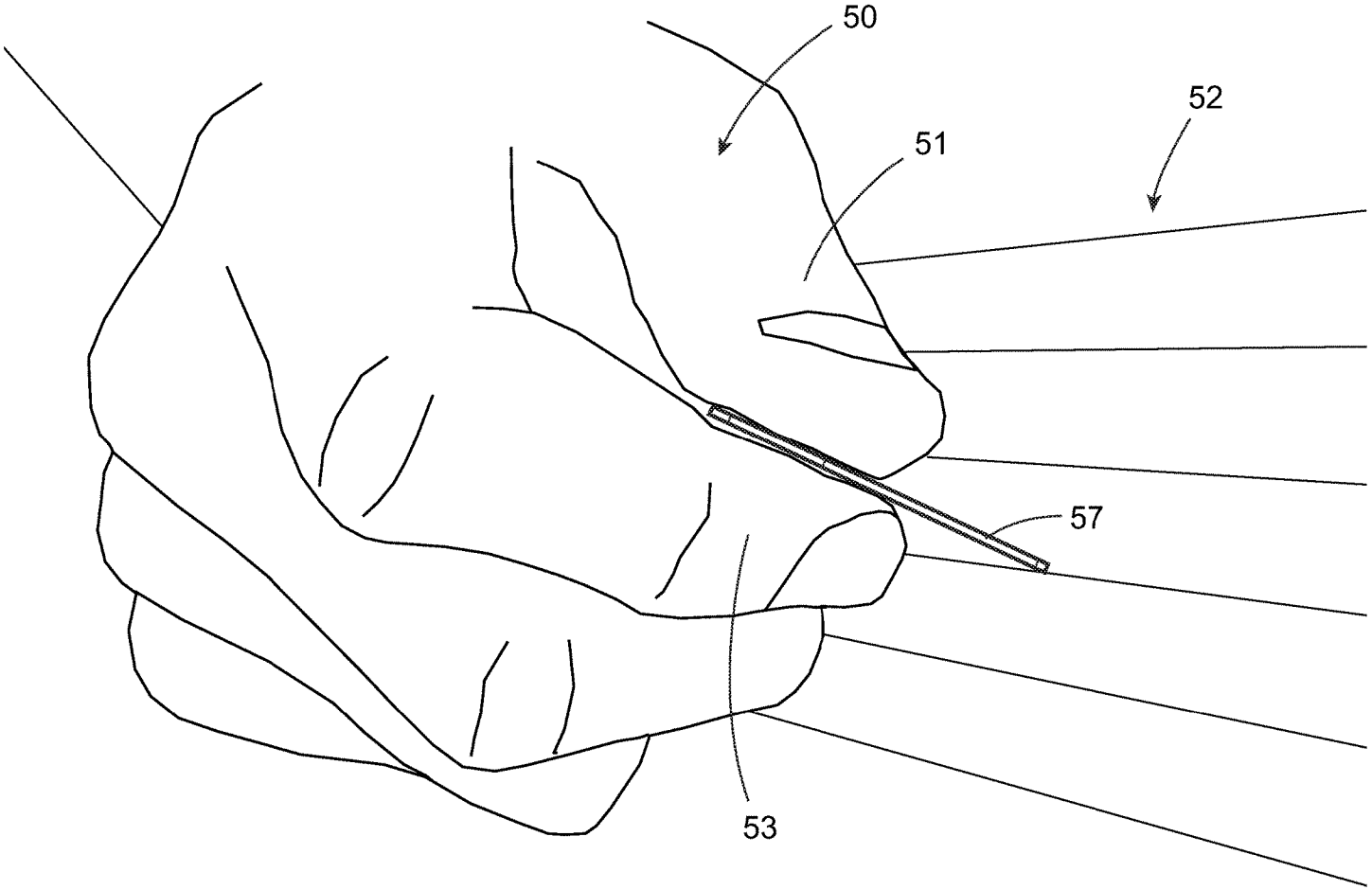
FIG. 9 (Prior Art)
FIG. 9 illustrates a hand of a musician holding and utilizing a conventional single-surface plectrum.

FIG. 9 illustrates the hand 50 of a musician striking the strings 52 using of a musical instrument using a prior art single-planar plectrum design 57 to illustrate and establish the customarily accepted grasping and striking locations and relationship to the hand to be maintained. The traditional single-planar plectrum design or prior art plectrum 57 is being held between the thumb 51 and index finger 53.

Figure 10:
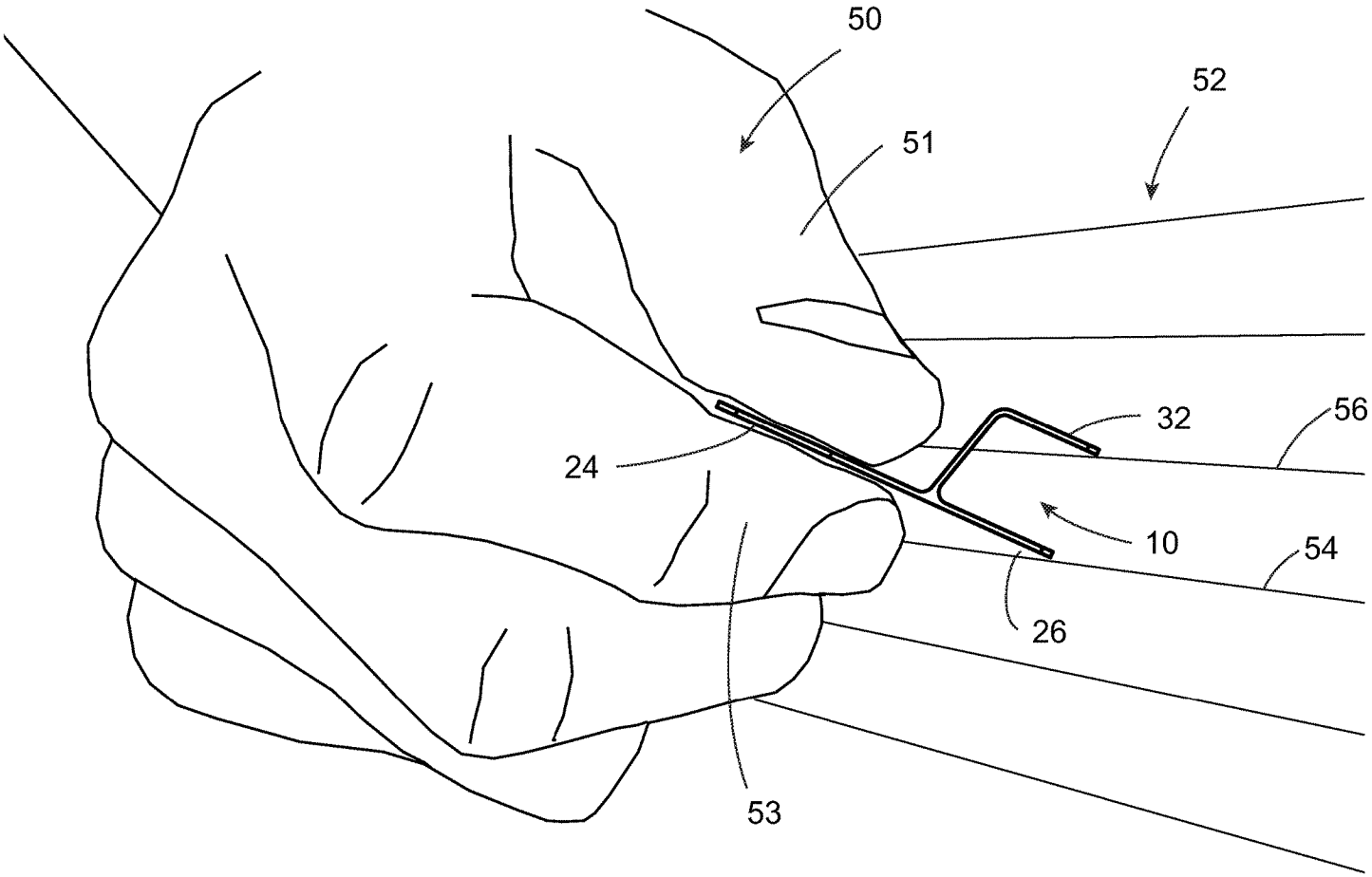
FIG. 10 illustrates a hand of a musician holding and utilizing the device shown in FIGS. 1-6 in a first orientation.

FIG. 10 illustrates a hand 50 of a musician striking the strings 52 of a musical instrument. The device 10 is being held between the thumb 51 and index finger 53 at grasping location 24 of the first planar member 12. In this illustrated example, the musician is striking the musical strings 52 with the striking surface or striking location 26 of the first planar member 12 on single string 54, and with the striking surface or striking location 32 of the second planar member 14 on single string 56. The result is an accompanying note that is at a tonal frequency below that of the note being played by the primary striking surface.

Figure 11:
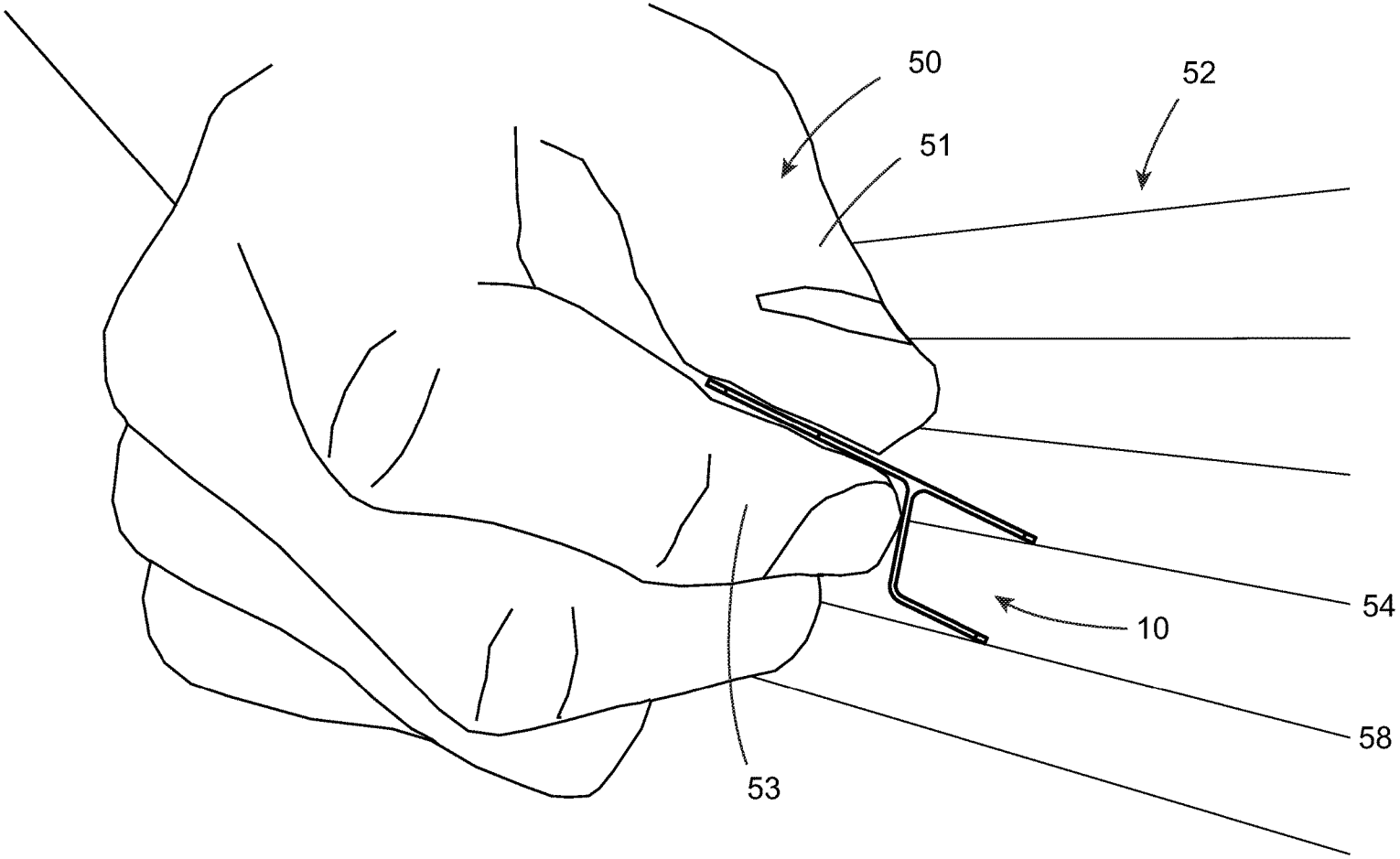
FIG. 11 illustrates a hand of a musician holding and utilizing the device shown in FIGS. 1-6 in a second orientation.

FIG. 11 illustrates the hand 50 of a musician striking the strings 52 of a musical instrument. The device 10 is being held between the thumb 51 and index finger 53 at grasping location 24 of the first planar member 12. In this illustrated example, the device is rotated 180 degrees compared with FIG. 10. As a result, the musician is striking the musical strings 52 with the striking surface 32 of the second planar member 14 on single string 58, and with the striking surface 26 of the first planar member 12 on single string 54. The result is an accompanying note that is at a tonal frequency above that of the note being played by the primary striking surface.

While specific embodiments have been shown and described to point out fundamental and novel features of the invention as applied to the preferred embodiments, it will be understood that various omissions and substitutions and changes of the form and details of the invention illustrated and in the operation may be done by those skilled in the art, without departing from the spirit of the invention.

The invention claimed is:

1. A device for striking multiple strings of a musical instrument, said device comprising:

a first planar plectrum having a top, a midsection, and a bottom;

a second planar plectrum having a top and a bottom;

a bracket connecting the top of the second planar plectrum to the midsection of the first planar plectrum; and wherein the first planar plectrum is within ten degrees of parallel to the second planar plectrum.

2. The device of claim 1, wherein the bracket is planar.

3. The device of claim 1, wherein width of the first planar plectrum decreases from the midsection to the bottom of the first planar plectrum; and wherein width of the second planar plectrum decreases from the top of the second planar plectrum to the bottom of the second planar plectrum.

4. The device of claim 1, wherein width of the top of the second planar plectrum is less than width of the midsection of the first planar plectrum.

5. The device of claim 1, wherein thickness of the first planar plectrum and the second planar plectrum is equal.

6. The device of claim 2, wherein an angle formed between the bracket and the striking location of the first plectrum is less than 90 degrees.

7. The device of claim 2, wherein an angle formed between the bracket and the striking location of the second planar plectrum is greater than 90 degrees.

8. The device of claim 1, wherein vertical distance from the bottom of the first planar plectrum to the top of the first planar plectrum is equal to vertical distance from the bottom of the second planar plectrum to the top of the first planar plectrum.

9. The device of claim 1, wherein first planar plectrum includes a grasping location between the top of the first planar plectrum and the midsection, and a striking location between the midsection and the bottom of the first planar plectrum, and thickness of the grasping location is equal to thickness of the striking location of the first planar plectrum.

10. A single-piece plectrum having an ancillary member for striking multiple strings of a musical instrument simultaneously, said plectrum comprising:

a first planar member having a top, a bottom, a grasping location, a midsection, and a striking location;

a second planar member having a top, a bottom, and a striking location;

a bracket connecting the top of the second planar member to the midsection of the first planar member; and said first planar member is substantially parallel to the second planar member plectrum.

11. The plectrum of claim 10, wherein the plectrum is formed from a single piece of nylon.

12. The plectrum of claim 10, wherein width of the first planar member decreases from the midsection to the bottom of the first planar member; and wherein wide of the second planar member decreases from the top of the second planar member to the bottom of the second planar member.

13. The plectrum of claim 10, wherein width of the top of the second planar member is less than width of the midsection of the first planar member.

14. The plectrum of claim 11, wherein an angle formed between the bracket and the striking location of the first planar member is less than 90 degrees.

15. The plectrum of claim 11, wherein an angle formed between the bracket and the striking location of the second planar member is greater than 90 degrees.

16. The plectrum of claim 10, wherein the grasping location is between the top of the first planar member and the midsection, and the striking location of the first planar member is between the midsection and the bottom of the first planar member.

17. The device of claim 10, wherein vertical distance from the bottom of the first planar member to the top of the first planar member is equal to vertical distance from the bottom of the second planar member to the top of the first planar member.

18. The plectrum of claim 10, wherein the plectrum is formed from a single piece of vinyl.

19. The plectrum of claim 10, wherein the plectrum is formed from a single piece of plastic.

20. A single-piece plectrum having an ancillary member for striking multiple strings of a musical instrument simultaneously, said plectrum comprising:

a first planar member having a top, a bottom, a grasping location, a midsection, and a striking location;

a second planar member having a top, a bottom, and a striking location;

a bracket connecting the top of the second planar member to the first planar member at a location below the top of the first planar member; and said first planar member is parallel to the second planar member plectrum.

* * * * *